US005131568A

United States Patent [19]

Ringuette

[11] Patent Number: 5,131,568

[45] Date of Patent: Jul. 21, 1992

[54] STORAGE AND DISPENSER SYSTEM

[76] Inventor: Paul G. Ringuette, 34 Jerry Rd., East Hartford, Conn. 06118

[21] Appl. No.: 585,837

[22] Filed: Sep. 20, 1990

[51] Int. Cl.[5] ..... B67D 5/40; B67D 5/60

[52] U.S. Cl. ..... 222/143; 222/130; 222/184; 222/382; 222/383; 222/464

[58] Field of Search ..... 222/130, 143, 383, 319, 222/135, 252, 321, 377, 382, 385, 464, 180, 184

[56] References Cited

U.S. PATENT DOCUMENTS

| | | | |
|---|---|---|---|
| 2,587,241 | 2/1952 | Steele | 222/385 X |
| 2,740,558 | 4/1956 | Steele | 222/385 X |
| 3,130,873 | 4/1964 | Klutz, Jr. | 222/131 |
| 3,349,967 | 10/1967 | Schneller | 222/130 |
| 3,858,686 | 1/1975 | Luterick | 222/464 X |
| 3,955,715 | 5/1976 | Topor | 222/143 |
| 4,143,795 | 3/1979 | Casebier | 222/143 |
| 4,798,312 | 1/1989 | Scheiber | 222/180 |
| 4,874,113 | 10/1989 | Schmidt | 222/143 |
| 4,972,973 | 11/1990 | Davis | 222/377 X |
| 4,998,647 | 3/1991 | Sharp | 222/143 |
| 5,062,549 | 11/1991 | Smith et al. | 222/464 |
| 5,083,683 | 1/1992 | Knickerbocker | 222/382 |

FOREIGN PATENT DOCUMENTS

| | | | |
|---|---|---|---|
| 891820 | 3/1962 | United Kingdom | 222/464 |

*Primary Examiner*—Donald T. Hajec
*Attorney, Agent, or Firm*—Robert A. Seemann

[57] ABSTRACT

A modular storage and dispenser system which is expandable to any number of reversibly joined, aligned modules, includes a pump for dispensing fluids, mounted through a front wall of a module, aligned in the front wall so that a portion of the external force received by the pump for operation of the pump is vectored at an angle that is oblique to the wall in order to reduce breaking force on the wall. The pump is oriented for dispensing forward and clear of the front wall, and to permit filling of the module while the pump is being operated for emptying the module.

6 Claims, 4 Drawing Sheets

STORAGE AND DISPENSER SYSTEM

BACKGROUND OF THE INVENTION

1. Field of the Invention

In general the invention relates to dispensing, more specifically a modular multicompartment dispenser including fluid discharge means for one or more of the compartments.

2. Description of the Prior Art

Advantages provided by ganged dispensers for delivering a plurality of different fluids, over use of a collection of supply containers in various sizes and shapes as purchased and arranged at the user site, have been recognized for over 25 years.

Two advantages are elimination of dispenser clutter at the user site, and cost saving. Cost saving is achieved by purchasing each product in larger more economical sizes than would be acceptable, if smaller purchased containers were arranged at the user site.

S. W. Klutz, Jr., in U.S. Pat. No. 3,130,873, patented Apr. 28, 1964 discloses a dispensing cabinet for a plurality of independently operated pressurized cans for such products as toothpastes, shaving creams, hand lotions, soaps and other fluid materials.

He provides a cabinet which stores the valved cans so that the contents of the cans may be dispensed from within the cabinet by remote operation of the valves. For this he describes a housing for receiving a plurality of cans. A hinged section of the front wall of the housing drops forward for receiving the cans. Each can includes a modified spout and valve structure. The spout includes a substantially elongated portion which connects with the conventional discharge tube of the can, and which extends through a hole in the front wall for dispensing the product. A knob extension is included on the conventional valve actuator flat surface, for engagement by an individually aligned valve actuator mechanism that is mounted on the housing.

The valve actuator mechanism includes a spring return plunger having a button outside the housing which may be pushed by an operator desiring a serving of the product. The actuator mechanism is designed and mounted for operation by vertical pressure on the button by the operator or designed and mounted for horizontal operator pressure. In the vertical design the button moves with the actuator mechanism axially to engage the knob. In the horizontal design the actuator mechanism engages the knob by way of a lobe of a downwardly oriented cam. The cam is radial to a shaft upon which it is located. The shaft is axially driven by the button and oriented so that the cam engages the knob for downward actuation when the shaft is driven toward the back wall of the housing. The spring return retracts the engaging portions of the valve actuator mechanism sufficiently to permit installation of the can without engagement by the mechanism.

J. W. Schneller, in U.S. Pat. No. 3,349,967, patented Oct. 31, 1967 discloses a housing with a plurality of longitudinally spaced openings through the upper surface of the housing for receiving therethrough a plurality of plunger-type pump assemblies. Each pump assembly is held in place in one of the openings by adhesive, and further by the threads of a container in which it resides. The plunger and spout of the assembly is held thereby above the upper surface, with the spout extending forward of the front of the housing, each opening being labeled on the front panel of the housing, below the respective spout, with the name of product being dispensed by the spout, i.e., hair grooming, shampoo, toothpaste, etc. The containers which may be empty baby food jars or the like, are filled with product from the packaging in which it is purchased. The front wall of the housing is attached to the housing by hinges. To load the housing, the front wall is hinged down to receive the filled container which is pushed upward into the proper threaded opening in the upper surface of the housing and screwed up into place against the sealing flange of the pump mechanism.

The present invention provides an expandable modular system comprising less parts than the prior art systems. Beyond the cost savings provided by buying the product which it dispenses in bulk for filling the system, it reduces the amount of waste from leavings of product in the bulk containers by providing for complete draining of the bulk containers into the system even while it is being used.

The system is expandable to any convenient number of fluid dispensing stations, as well as to stations for temporary storage of convenient items such as tools, a comb or a toothbrush and toothpaste.

In the present invention, pump assemblies for dispensing fluid from a module are oriented for reduction of harmful stress on the module wall when they are operated, and for easy access by one hand of the user simultaneously to the pump and to the product it dispenses.

SUMMARY OF THE INVENTION

It is one object of the invention to provide a storage and dispenser system which is modular.

It is another object of the invention to provide a modular storage and dispenser system which is expandable to any number of modules.

It is another object to provide the above system in which modules dispense fluids and hold objects for retrieval.

Yet another object is to provide a dispensing arrangement in the modules which places minimum breaking force on a module when it is being operated for dispensing.

It is another object of the invention that the system can stand on a surface or hang on a wall.

It is another object that the form taken by the assembled modules be repeatable with each assembly effort.

In accordance with the invention a first module includes first and second opposed side walls connected to a third back wall, a fourth front wall connected to the side walls, and a fifth bottom wall attached sealingly to all the walls for forming a fluid tight container. The bottom wall includes a sloping portion for establishing a low area for liquid in the container.

A pump for dispensing fluids is mounted through the front wall, with one end of the pump being forward of and spaced from the front wall for dispensing fluid forward and clear of the front wall. The pump includes a tube which is arranged for drawing fluid from the container including from the low area.

The pump is operable by application of external force and includes a surface for receiving such external force. The alignment of the pump in the front wall is such that a portion of the external force received by the surface is vectored at an angle that is oblique to the front wall in order to reduce components of the external force upon the wall that would tend to break the wall.

Preferably the pump is aligned in the front wall so that portions of the external force received by the surface are vectored toward the back and bottom walls.

A second module includes at least three upstanding walls and a bottom wall attached to one another so as to form an open top container.

A means for joining a side wall of the first module with an upstanding side of the second module is provided for joining the modules together. Preferably the means for joining includes means for establishing a planned, aligned and fixed relationship between the first and second modules.

One means for joining a side wall of the first module with an upstanding wall of the second module includes a flange on one of the walls for joining and a mating groove on the other of the walls for joining. The means for joining is reversible so that the joined walls are separable.

Another means for joining includes a stud on one of the walls for joining, and a mating depression on the other wall for joining in order to establish the aligned relationship. A reversible fastener provides the fixed relationship so that the joined walls are separable.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
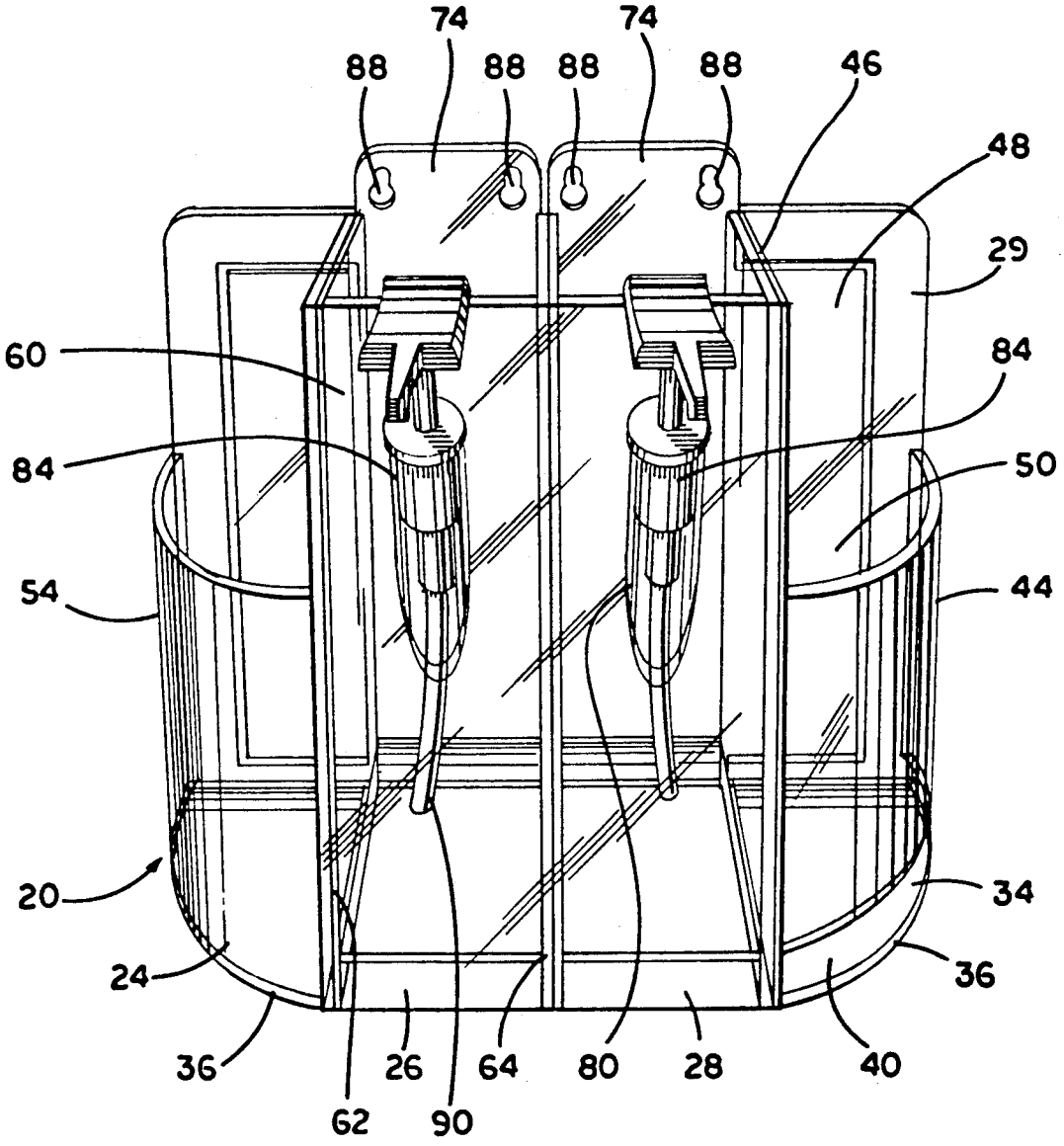
FIG. 1 is a top front perspective view of a dispenser system according to a preferred embodiment of the invention.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Referring to FIG. 1 of the drawings, storage and dispenser system 20 has four modules. The modules are preferably made from a transparent plastic as shown, such as LEXANtm #141 Smoke, or a translucent plastic so that status of the contents may be observed. If an opaque material is chosen for manufacture, it is preferred that a transparent or translucent sight window be incorporated for observation of contents.

Modules 24 and 29 are designed for temporary storage of solid items such as a tooth brush, toothpaste, comb or tools. Modules 26 and 28 are designed for storing and dispensing fluids such as shampoo, aftershave, hair tonic, liquid soap, toothpaste, ketchup, or work shop fluids.

Figure 3:
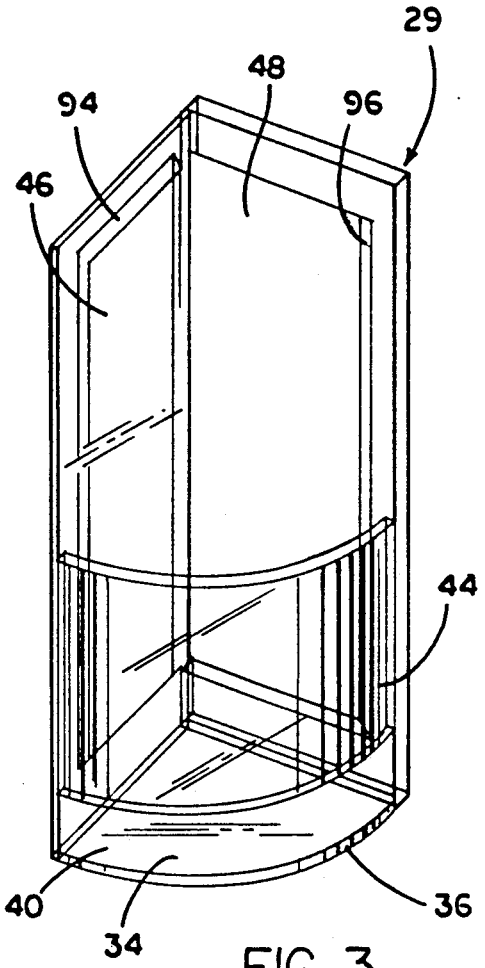
FIG. 3 is a perspective view of another module of the invention.
Figure 5:
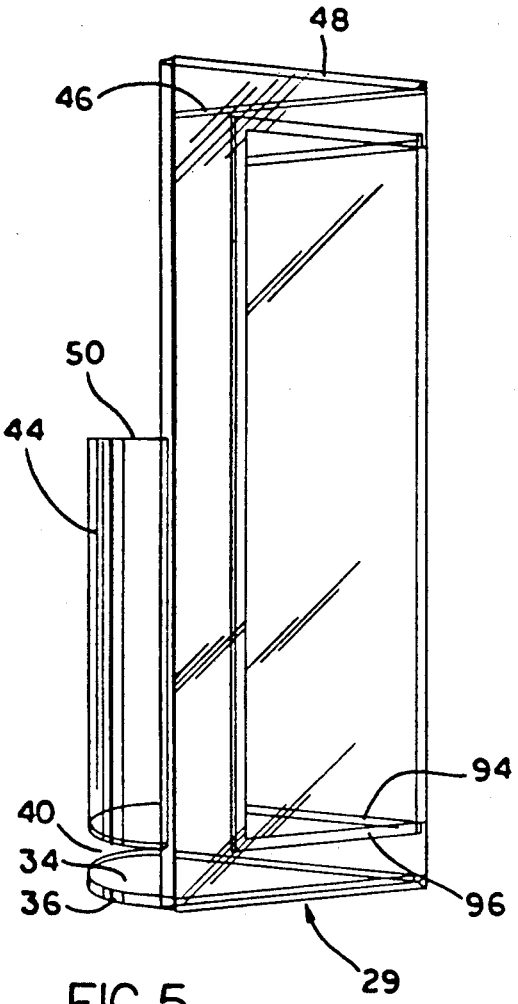
FIG. 5 is a side perspective view of the module shown in FIG. 3, viewed from another angle.
Figure 6:
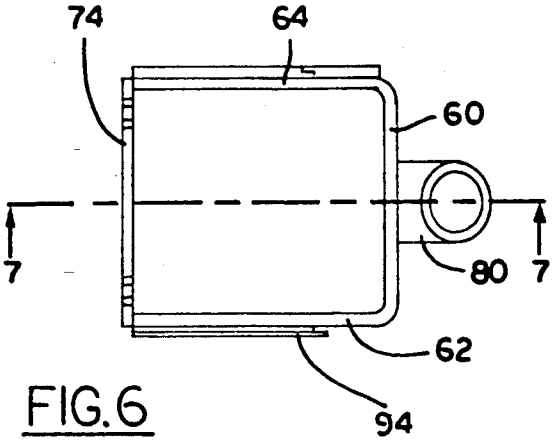
FIG. 6 is a top view of the module shown in FIG. 2, less the installed pump.
Figure 7:
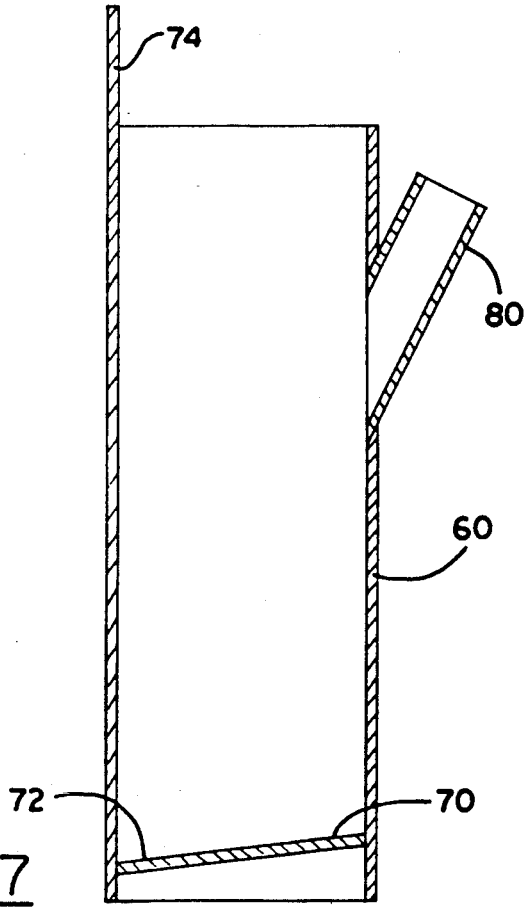
FIG. 7 is a sectioned side view of the module shown in FIG. 6 viewed at 7—7.

As may be seen in FIGS. 1, 3 and 5, floor 34 of module 29 is planar to edge 36 so that excess water which may drain from items placed in the module may drain out by way of opening 40. It is preferred for sanitary purpose that there be no standing water in a tooth brush holder beyond random drops which evaporate. Opening 40 prevents accumulation in the module of drainage from toothbrushes and other wet items stored in the module.

Curved upstanding wall 44 and flat upstanding walls 46 and 48 are joined to form an open top container for retaining solid items which are inserted into the module by way of opening 50. Although wall 44 is shown curved, it may instead comprise one or more angled walls in cooperating to form the open top container.

In module 24, curved wall 54 joins with floor 34 to form a seal so that module 20 comprises a water tight container. Module 24 may be used to hold a comb and brush or a powder container wherein it would be more convenient to retain product in the module in case of a leak from the powder container.

Module 26, FIGS. 1, 2, 6 and 7 is identical to module 28. It is water tight sealed between front wall 60, side walls 62 and 64, and slanted floor 70, while back wall 74 is also water tight sealed between side walls 62, 64 and floor 70.

Front wall 60 includes guide sleeve 80 which receives hand pump 84. Guide sleeve 80 orients pump 84 so that the thrust vector of pressure received from palm or finger applied to button 86 to operate the pump is downward and toward back wall 74, preferably at an angle of less than 60 degrees with with respect to wall 60. Preferably sleeve 80 includes a ½ degree inward taper.

The shallow angle of the pump centerline with respect to wall 60 vectors much of the operating thrust parallel to wall 60, thereby reducing the breaking force that is perpendicular to that wall.

In most installations assembly 20 is resting on a counter top, snugly back against the counter wall, or it is attached by screw holes 88 to a wall. The downward and backward directed operating thrust tends to maintain system 20 at rest.

Although pump 84 as shown includes a button 86 for applying hand pressure axially of the pump, an off set lever or other pressure translating element may be used to drive the pump.

Pump 84 may be an electric pump. If pump 84 is an electric one, it is preferred that button 86 be located over spout 82 for convenient one hand dispensing. Spout 82 extends forward of wall 60 for delivering product forward and clear of the module.

Pump 84 is of a heavy duty type designed for pumping fluids of high viscosity such as shampoo, conditioner, liquid soap, toothpaste and even work bench lubricants.

Pickup tube 90 terminates at the juncture of wall 74 and the lowest end 72 of slanted floor 70 which is sloped for drawing up the last bit of product in the module. Preferably a moderate slope such as 5 to 12 degrees is used.

Storage and dispenser system 20 is modular. It is expandable and is constructed of two or more modules in combination for storing and dispensing solid articles or fluids wherein the assembled system is a single rigid unit.

Each module includes an element for aligning it with another module so that when they are fastened together all modules are in planned fixed relationship to one another. An alignment element may be a pin or a detent for receiving the pin, a hole which aligns with another on the adjacent module for receiving a screw or an expanding fastener, or the alignment element may be one that both aligns and fastens.

Preferably the back walls such as 74 and 48 are aligned coplanar for good back support. The assembly may however be arranged in an "L", "T", or "U" configuration. This is accomplished for example by adding module 24 to back wall 48 of module 29.

In one preferred alignment and fastening arrangement as shown in FIGS. 2, 3, 5, and 6, flange 94 and groove 96 slidably interlock to align, hold and support adjacent modules, forming a rigid system when modules are assembled together. To assemble, each module is added by sliding it backward against the module to its right until it comes to a stop.

Figure 8:
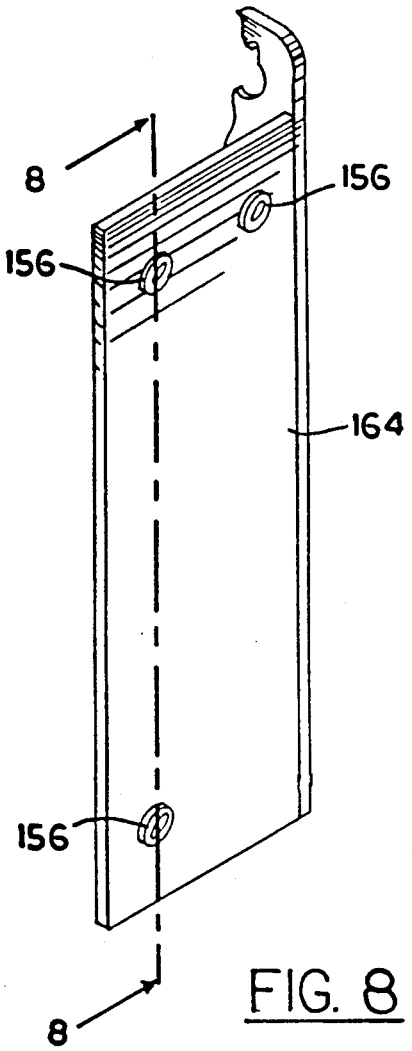
FIG. 8 is a perspective view of a wall of a module according to another preferred embodiment of the invention.
Figure 9:
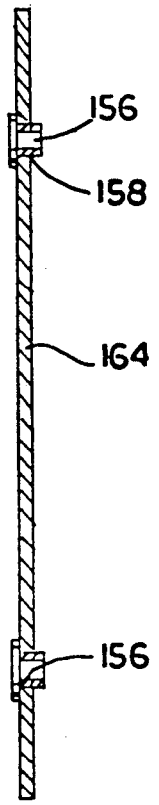
FIG. 9 is a sectioned edge view of the wall shown in FIG. 8 viewed at 8—8.

In another preferred and more economical construction, pins or holes with fasteners are provided instead of the flange and groove arrangement. For example, as shown in FIGS. 8 and 9, posts 156 of the RAPID ASSEMBLY POST AND SCREW brand fastener system (patent pending) are fixed in fluid tight seal by interference fit or by glue in side wall 164 which corresponds to wall 64 of the flange and groove arrangement. Each post 156 extends beyond the outer face of wall 164, presenting a dual purpose alignment stud and quick lock receptacle for a threaded screw.

The RAPID ASSEMBLY POST AND SCREW brand fastener, available from Ark-Plas Products Inc., Flippin, Ark. 72634, includes a flexible hollow post which cold flows around threads of a rigid plastic screw to lock the two parts together when the screw and post are pressed together. For disassembly the post and screw are unscrewed from one another.

Figure 10:
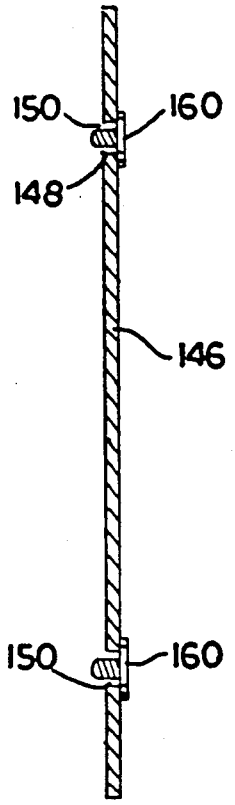
FIG. 10 is a sectioned edge view of a wall of a module according to another preferred embodiment of the invention.

Referring to FIG. 10, wall 146 corresponds to wall 46 of the flange and groove arrangement. Inner diameter 148 of holes 150 closely receives outer diameter 158 of post 156. Post 156 receives threads of screw 160 by pressing together as described earlier, thereby bringing walls 164 and 146 into a reversible closely fastened, aligned relationship.

Figure 11:
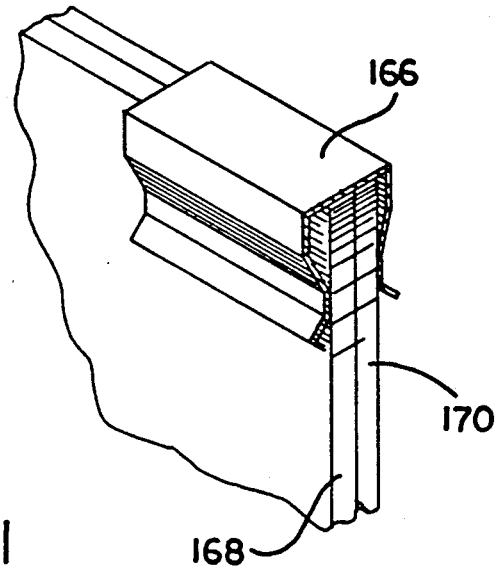
FIG. 11 is a partial view of two walls of modules joined according to another embodiment of the invention.

Still another fastener for joining the modules in aligned and fixed relationship is shown in FIG. 11. Clip 166 slips over the ends of upstanding walls 168 and 170 of adjacent modules. Preferably two clips are used, one at the top of the walls and the other at the bottom of the walls. The bottom clip is preferably attached on the side wall toward the front of the module where the floor of the fluid storage and dispenser module, which should not be penetrated by the clip, is higher.

A first fastening means may be used for joining a first module to a second one, and a second fastening means for joining the first module to a third one. The first and second fastening means may be the same or may differ from one another according to the design desired.

Figure 2:
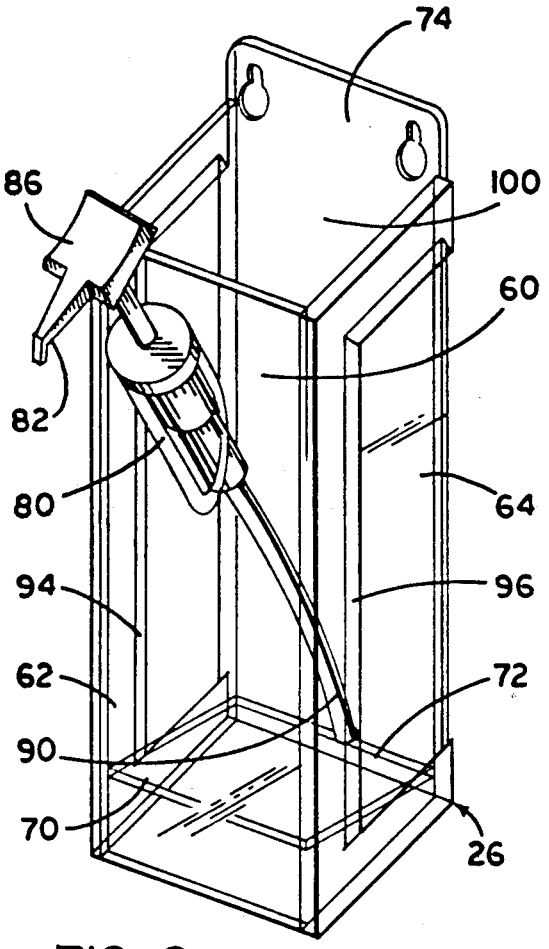
FIG. 2 is a perspective view of one module of the invention with an installed pump.
Figure 4:
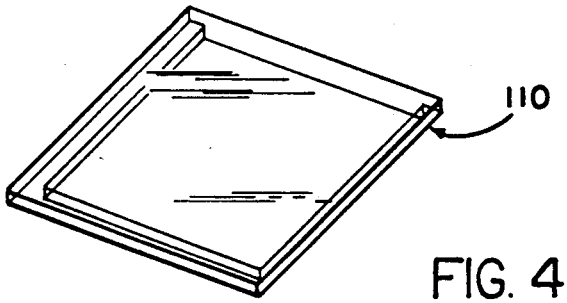
FIG. 4 is a perspective view of a cover for the module shown in FIG. 2.

Referring to FIG. 2, button 86 stands forward of filler opening 100, providing an unobstructed opening for filling module 26 and supporting a bulk container of product with the top of the module so that the container can be left to drain completely. If desired, the pump can be operated while a bulk container is draining into opening 100. When module 26 is not being filled, it is covered by inward flanged cover 110, FIG. 4. Although the flange is shown to extend around three edges of the cover, it is to be understood that short flange sections may be used.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. A modular expandable storage and dispenser system comprising:

a first module, a second module, said first module including; a first side wall, a second side wall opposite to said first wall, a third back wall attached to said first and second walls, a fourth front wall opposite to said back wall and attached to said first and second walls, and a fifth bottom wall attached sealingly to said first, second, third and fourth walls for forming a fluid tight first container, said first, second and third walls forming an opening at the top of said first container for filling said first container, a pump for dispensing fluids, mounted through said fourth wall, said pump having a first end and a second end, said first end being forward of and spaced from said fourth wall for dispensing fluid forward and clear of said fourth wall, said second module including a sixth upstanding wall, a seventh upstanding wall attached to the sixth wall, an eighth upstanding wall, and a ninth bottom wall, said sixth, seventh, eighth and ninth walls being attached to one another so as to form an open top second container, means for joining one of said side walls of said first module with one of said side walls of said second module for joining the modules together, said means for joining comprising means for establishing a planned, aligned and fixed relationship between said first and second modules, and being reversible so that said joined walls are separable, said pump being of the type that is operable by application of external force, and said front end of said pump comprising a surface for receiving such external force for said operation, said pump being mounted through predominantly the upper half of said fourth wall, and aligned in said fourth wall so that said external force received by said surface for receiving for operating said pump is vectored toward said third back wall and said fifth bottom wall at an angle of less than 60 degrees with respect to said fourth wall of said first container.

2. The modular expandable storage and dispenser system described in claim 1, further comprising:

said reversible means for joining comprising a stud on one of said joined walls, spaced inward from the edges of the walls to which the one joined wall is immediately attached, and a mating depression on the other of said joined walls, for establishing said aligned relationship.

3. The modular expandable storage and dispenser system described in claim 1 further comprising:

said means for joining the side walls comprising a flange on one of the joined walls, and a mating groove on the other of the joined walls for establishing said aligned and fixed relationship, said groove being oriented front to back, and including a stop, short of the full width of the wall on which it is located, so that said joined walls slide horizontally to stop in fixed, planned horizontal and vertical relationship.

4. A modular expandable storage and dispenser system comprising:

a first module, a second module, said first module including; a first side wall, a second side wall opposite to said first wall, a third back wall attached to said first and second walls, a fourth front wall opposite to said back wall and attached to said first and second walls, and a fifth bottom wall attached sealingly to said first, second, third and fourth walls for forming a fluid tight first container, said first, second, third and fourth walls forming an opening at the top of said first container for filling said first container, a pump for dispensing fluids, mounted through said fourth wall, said pump having a first end and a second end, said first end being forward of and spaced from said fourth wall for dispensing fluid forward and clear of said fourth wall, said second module including a sixth upstanding wall, a seventh upstanding wall attached to the sixth wall, an eighth upstanding wall, and a ninth bottom wall, said sixth, seventh, eighth and ninth walls being attached to one another so as to form an open top second container, means for joining one of said side walls of said first module with one of said side walls of said second module for joining the modules together, said means for joining comprising means for establishing a planned, aligned and fixed relationship between said first and second modules, said means for joining being reversible so that said joined walls are separable, said pump being of the type that is operable by application of external force, and said pump comprising a surface for receiving such external force for said operation, said pump being aligned in said said fourth wall so that a portion of said external force received by said surface for receiving for operating said pump is vectored obliquely to said fourth wall with the thrust vector against said fourth wall of said first container making an angle of less than 60 degrees with said fourth wall for reduction of breaking force on said fourth wall, said fifth wall including a downward sloping portion, and said fourth wall extending below the attachment of said fifth wall to said fourth wall.

5. The modular expandable storage and dispenser system described in claim 4, further comprising:

said fourth wall further comprising a guide sleeve for slidingly downward receiving said pump and for said orientation of said pump in said fourth wall, with the centerline of said pump making an angle of less than 30 degrees with said fourth wall, a portion of said sleeve including a reduced diameter for limiting downward movement of the pump.

6. The modular expandable storage and dispenser system described in claim 4, further comprising:

said reversible means for joining comprising a stud on one of said joined wall, spaced inward from the edges of the walls to which the one joined wall is immediately attached, and a mating depression of said system on the other of said one joined wall for establishing a horizontally and vertically aligned relationship.

* * * * *

UNITED STATES PATENT AND TRADEMARK OFFICE

CERTIFICATE OF CORRECTION

PATENT NO. : 5,131,568

DATED : July 21, 1992

INVENTOR(S) : Paul G. Ringuette

It is certified that error appears in the above-identified patent and that said Letters Patent is hereby corrected as shown below:

Claim 6, line 6, delete "of said system".

Signed and Sealed this

Tenth Day of August, 1993

*Attest:*

Michael K. Kirk

MICHAEL K. KIRK

*Attesting Officer*

*Acting Commissioner of Patents and Trademarks*